US007663043B2

(12) United States Patent
Park

(10) Patent No.: US 7,663,043 B2
(45) Date of Patent: Feb. 16, 2010

(54) DISPLAY DEVICE FOR GUITAR TUNERS AND METHOD OF DISPLAYING TUNED STATES OF GUITAR STRINGS USING THE SAME

(75) Inventor: In Jae Park, Seoul (KR)

(73) Assignee: Sungeum Music Co. Ltd (KR)

( * ) Notice: Subject to any disclaimer, the term of this patent is extended or adjusted under 35 U.S.C. 154(b) by 0 days.

(21) Appl. No.: 11/875,366

(22) Filed: Oct. 19, 2007

(65) Prior Publication Data

US 2009/0056523 A1 Mar. 5, 2009

(30) Foreign Application Priority Data

Aug. 31, 2007 (KR) ..... 10-2007-0088218

(51) Int. Cl.
*G10G 7/02* (2006.01)

(52) U.S. Cl. ..... 84/455; 84/454

(58) Field of Classification Search ..... 84/455, 84/454, 477 R

See application file for complete search history.

(56) References Cited

U.S. PATENT DOCUMENTS 6,291,755 B1 * 9/2001 Hine et al. ..... 84/454
2001/0003940 A1 * 6/2001 Kondo ..... 84/1
2002/0088333 A1 * 7/2002 Skubic ..... 84/477 R
2005/0183566 A1 8/2005 Nash
2008/0105108 A1 * 5/2008 Saenz ..... 84/485 R

FOREIGN PATENT DOCUMENTS

WO WO 02/080137 10/2002
WO WO 2004/109244 12/2004

* cited by examiner

*Primary Examiner*—Jeffrey Donels
*Assistant Examiner*—Jianchun Qin
(74) *Attorney, Agent, or Firm*—Robert W. Becker & Assoc; Robert W. Becker

(57) ABSTRACT

A display device for guitar tuners and a method of displaying the tuned states of guitar strings. The method is performed such that the control unit performs control so that the backlight emits light having a predetermined color by turning on the backlight when a tuner is turned on, and then performs control so that the backlight emits light having a different color when the tuning of guitar strings is completed using the display device, which includes a Liquid-Crystal Display (LCD) panel provided in an equalizer mounted to a guitar body, and configured to display the tuned states of the guitar strings, a backlight mounted behind the LCD panel, and a control unit configured to control the LCD panel and the backlight.

2 Claims, 6 Drawing Sheets

DISPLAY DEVICE FOR GUITAR TUNERS AND METHOD OF DISPLAYING TUNED STATES OF GUITAR STRINGS USING THE SAME

BACKGROUND OF THE INVENTION

1. Field of the Invention

The present invention relates generally to a tuner that is used to tune a guitar and, more particularly, to a display device for guitar tuners and a method of displaying the tuned states of guitar strings using the same, in which a backlight is mounted in a display device, which is provided in an equalizer mounted to a guitar body, and displays the tuned states of guitar strings using a Liquid Crystal Display (LCD) panel, thus enabling the tuned states to be easily observed even in dark places by increasing the brightness of the LCD panel during a tuning process, and which, when tuning is completed, enables a tuning completion state to be easily known by converting the color of emitted light, thus making tuning convenient for players.

2. Description of the Related Art

A guitar is a musical instrument that produces sound when a plurality of guitar strings are strummed or plucked. Generally, six guitar strings, each of which produces a different sound, are mounted parallel to each other, and the individual guitar strings are tuned so that the intrinsic pitches can be produced by rotating pegs after the guitar strings are installed.

Conventionally, when guitar strings are tuned, a player 5 must determine whether the guitar strings produce their intrinsic pitches using his or her auditory sense. However, it is difficult to determine whether the guitar strings are accurately tuned using the auditory sense if the player is not an expert.

In order to solve this problem, a tuner that enables the automatic determination of accurate tuning so that the intrinsic pitches of guitar strings are realized has been developed and used.

The conventional tuner enables the determination of 15 accurate tuning by displaying the pitches of respective guitar strings for which tuning is conducted using an LCD panel. However, the LCD panel of the tuner is a body that does not emit light itself, and thus it is difficult to easily and quickly observe tuned states. In particular, a number of places at which a guitar is played, and waiting places, such as backstage locations, are dark, and thus it is difficult for players to observe pitch indication and tuning completion indication, which are displayed on the LCD panels of their tuners, when performing tuning.

SUMMARY OF THE INVENTION

Accordingly, the present invention has been made keeping in mind the above problems occurring in the prior art, and the present invention is intended to provide a display device for guitar tuners, which enables a player to easily observe the tuned states of guitar strings and a tuning completion state, thus enabling the guitar strings to be conveniently tuned even in dark places.

Furthermore, the present invention is intended to provide a method of displaying the tuned states of guitar strings using the display device, which enables a player to easily observe the tuned states of guitar strings and a tuning completion state, thus enabling the guitar strings to be conveniently tuned even in dark places.

The present invention provides a display device for guitar tuners, including: a Liquid Crystal Display (LCD) panel, which is provided in an equalizer mounted to a guitar body, and is configured to display the tuned states of guitar strings; and a backlight, which is mounted behind the LCD panel.

Furthermore, the backlight changes the color of light when the tuning of the guitar strings is completed.

Furthermore, the backlight emits light having an orange 25 color when a tuner is turned on, and emits changed light having a green color when the tuning of the guitar strings is completed.

In addition, the present invention provides a method of displaying the tuned states of guitar strings using a display device, the display device including an LCD panel provided in an equalizer mounted to a guitar body, and configured to display the tuned states of the guitar strings, a backlight mounted behind the LCD panel, and a control unit configured to control the LCD panel and the backlight, the method including: the control unit performing control so that the backlight emits light having a predetermined color by turning on the backlight when a tuner is turned on; and the control unit performing control so that the backlight emits light having a different color when the tuning of the guitar strings is completed.

Furthermore, the backlight emits light having an orange color when a tuner is turned on, and emits changed light having a green color when the tuning of the guitar strings is completed.

BRIEF DESCRIPTION OF THE DRAWINGS

The above and other objects, features and advantages of the present invention will be more clearly understood from the following detailed description, taken in conjunction with the accompanying drawings, in which.

DESCRIPTION OF THE PREFERRED EMBODIMENTS

The present invention is described in detail with reference to the accompanying drawings below.

Figure 1:
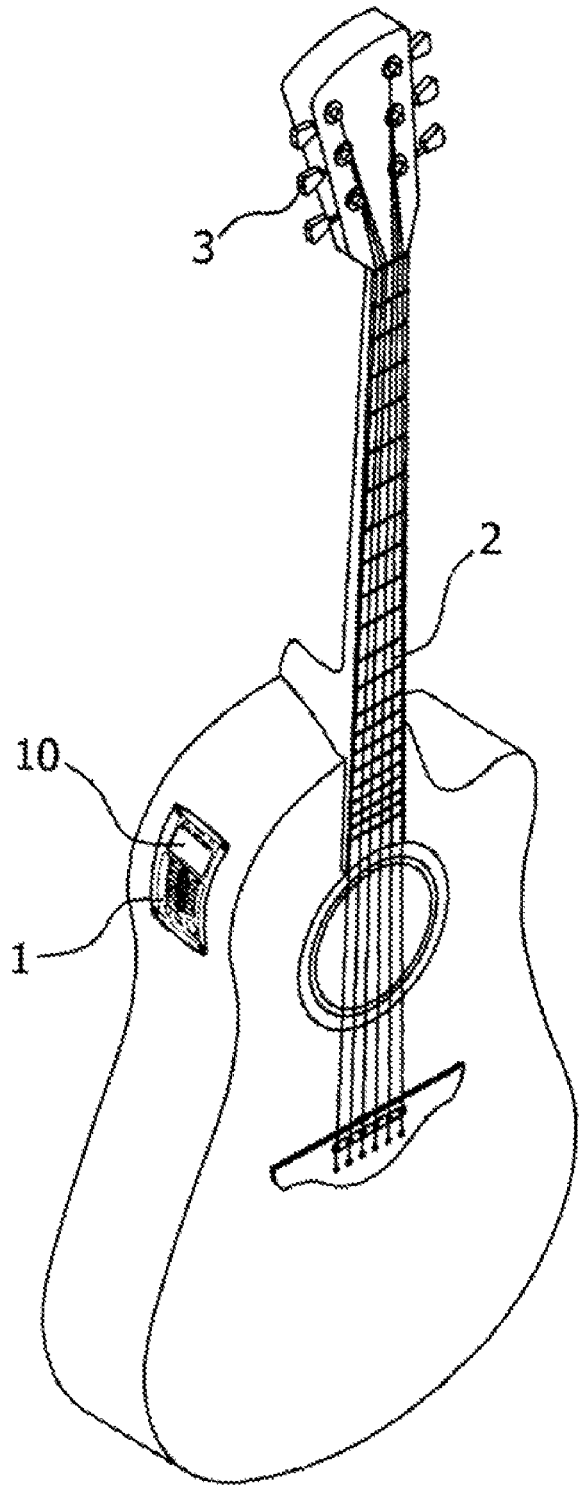
FIG. 1 is a perspective view of a guitar, which is provided with an equalizer to which a display device for guitar tuners is mounted, according to the present invention.
Figure 2:
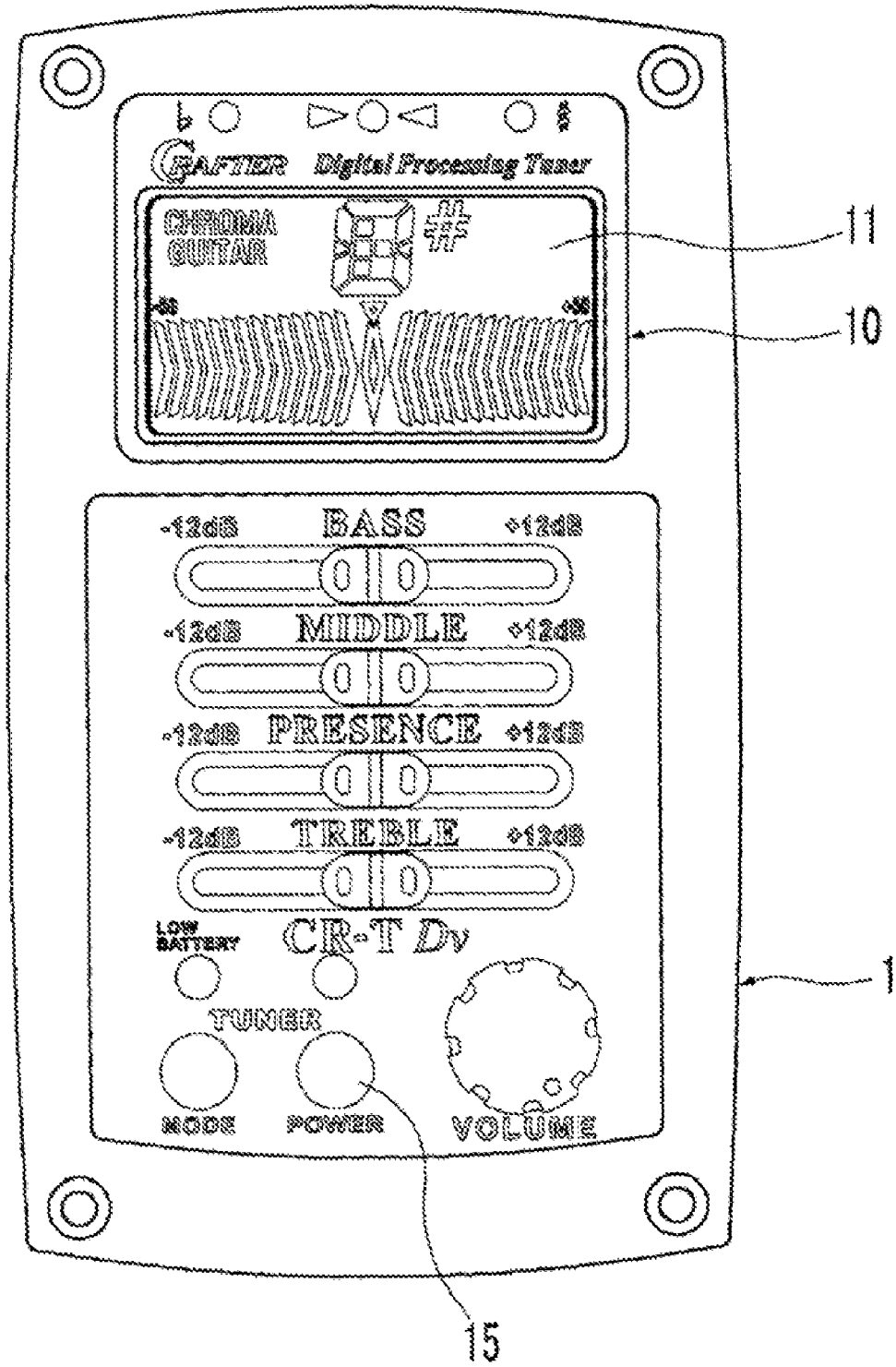
FIG. 2 is a plan view of the equalizer to which the display device for guitar tuners is mounted, according to the present invention.
Figure 3:
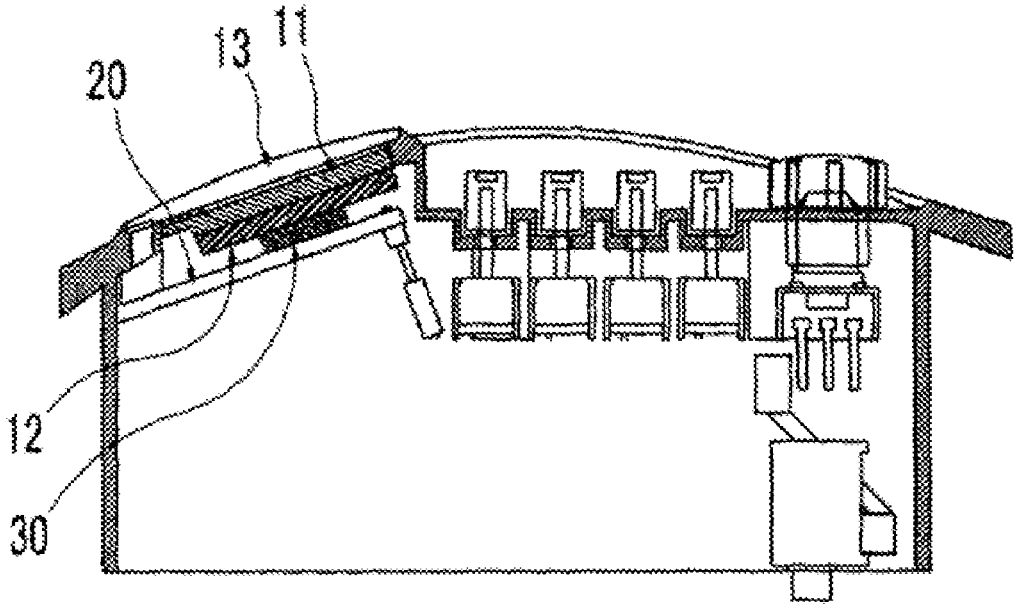
FIG. 3 is a sectional view of the equalizer to which the display device for guitar tuners is mounted, according to the present invention.

FIG. 1 is a perspective view of a guitar, which is provided with an equalizer to which a display device for guitar tuners is mounted, according to the present invention, FIG. 2 is a plan view of the equalizer to which the display device for guitar tuners is mounted, according to the present invention, and FIG. 3 is a sectional view of the equalizer to which the display device for guitar tuners is mounted, according to the present invention.

As shown in FIG. 1, the display device 10 of the present invention includes an equalizer 1 that is mounted to a guitar body. The equalizer 1 is mounted at a predetermined location of a guitar body in order to amplify guitar sound, which is produced when guitar strings 2 are strummed or plucked, through a separate speaker.

The equalizer 1 functions to adjust and modulate various S components of sound, such as bass, midrange and treble, which are produced by the guitar body. The equalizer 1 is electrically connected to the amplifier/speaker system via a jack that is mounted to the guitar body. Accordingly, when the guitar is played, the sound, which is produced by the guitar body, is appropriately adjusted and amplified, so that a loud sound can be listened to through the speaker.

The display device 10 for guitar tuners according to the present invention, as shown in FIGS. 2 and 3, includes an LCD panel 11 for displaying the tuned states of guitar strings, a backlight 12 mounted behind the LCD panel 11, and an acrylic panel 13 mounted in front of the LCD panel 11.

The LCD panel 11 is configured to display various tuned states, which will be described later, using a great number of segments. This LCD panel 11 does not emit light itself, and thus it is difficult to be aware of display information if the LCD panel 11 is not located in a bright place.

The backlight 12 includes a light source, a Light Guide Plate (LGP) having a light guide function, a lamp cover having a light reflecting function, a reflector sheet, a diffuser sheet having a light diffusing function, a diffuser plate, and a prism sheet having a brightness enhancement function.

The light source is responsible for supplying light. In this case, it is preferred that the light source be able to change the color of light. The LGP is responsible for converting linear light into planar light. The lamp cover is responsible for reflecting light from the light source to the LGP. The reflector sheet is responsible for preventing light loss from occurring in a rear part. The diffuser sheet is responsible for diffusing light from the LGP. The diffuser plate is responsible for obscuring the visibility of the light source. The prism sheet is responsible for converging light within a specific angle range.

Since the above-described backlight is a well-known technology, a detailed description thereof is omitted.

The acrylic panel 13 is responsible for protecting the LCD panel 11.

The above-described display device 10 is controlled by a control unit 20, which is provided in a tuner Printed Circuit Board (PCB). A buffering member 30, such as a sponge, is interposed between the backlight 12 and the control unit 20, and protects the LCD panel 11 and backlight 12.

The present invention causes the color of light, emitted from the backlight 12, to be changed when the tuning of the guitar strings is completed. In greater detail, the color of light emitted from the backlight 12 is orange when the display device is turned on and thus is in an operating state, and the color of light emitted from the backlight 12 is changed to green when the tuning of the guitar strings 2 is completed.

The method of displaying the tuned states of guitar 5 strings using the display device for guitar tuners according to the present invention, described above, is described with reference to FIGS. 4A to 4E below.

Figure 4A:
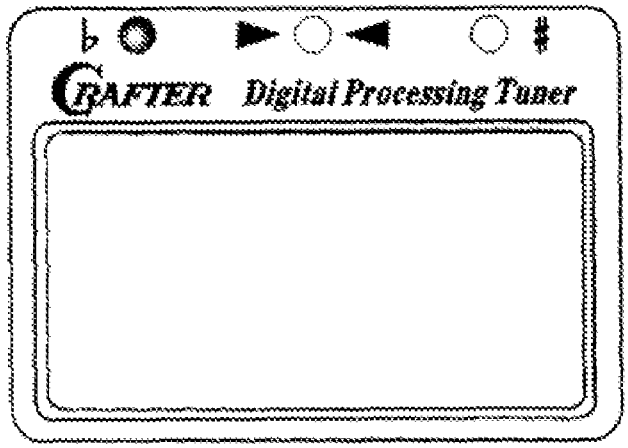
FIG. 4A is a diagram showing a display screen which indicates that the display device for guitar tuners is in an 'OFF' state, according to the present invention.
Figure 4B:
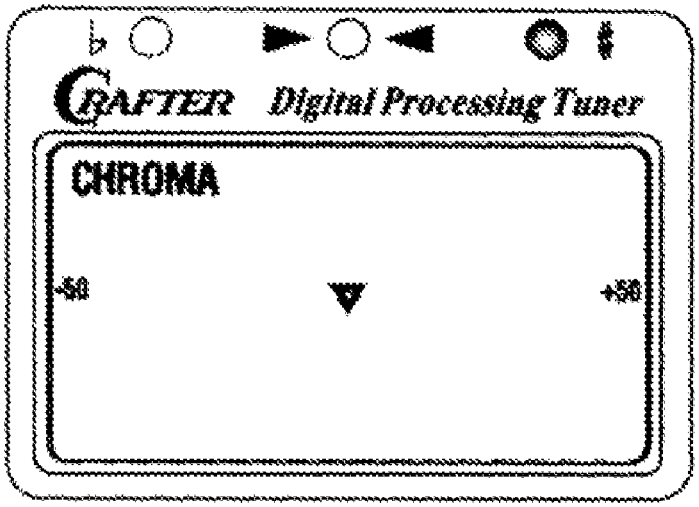
FIG. 4B is a diagram showing a display screen which 15 indicates that the display device for guitar tuners is in an 'ON' state, according to the present invention.
Figure 4C:
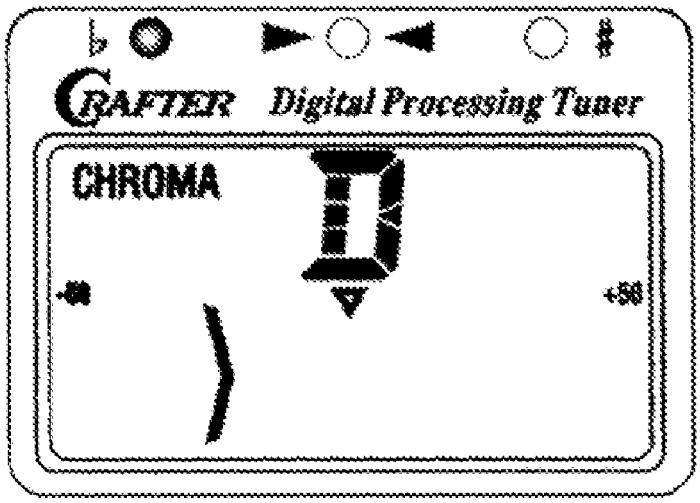
FIG. 4C is a diagram showing an example of a display screen which indicates that the pitch of a guitar string is low when the display device for guitar tuners is in an 'ON' state while tuning is being performed, according to the present invention.
Figure 4D:
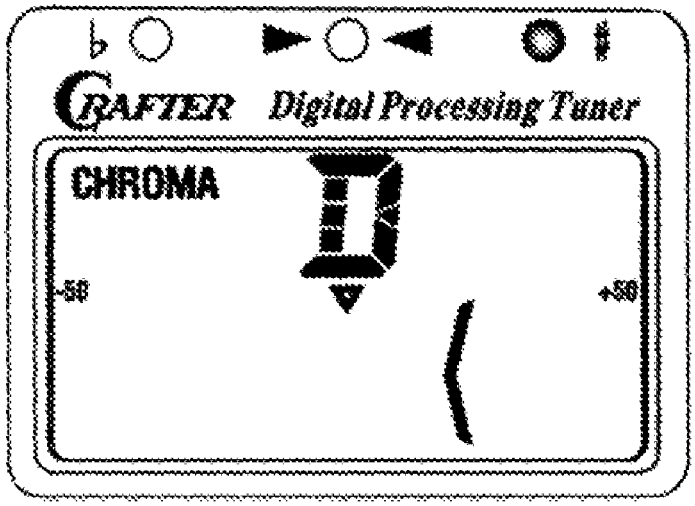
FIG. 4D is a diagram showing an example of a display screen which indicates that the pitch of a guitar string is high when the display device for guitar tuners is in an 'ON' state while tuning is being performed, according to the present invention.
Figure 4E:
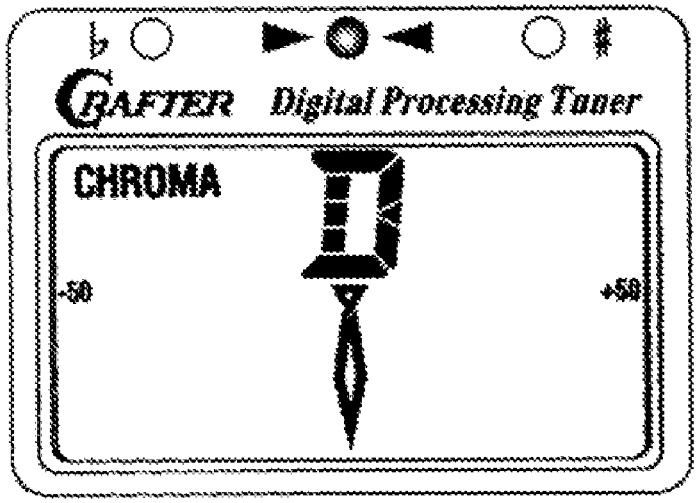
FIG. 4E is a diagram showing a display screen which indicates that tuning is completed when the display device for guitar tuners is in an 'ON' state, according to the present invention.

FIG. 4A is a diagram showing a display screen which indicates that the display device for guitar tuners is in an 'OFF' state, according to the present invention, FIG. 4B is a diagram showing a display screen which indicates that the display device for guitar tuners is in an 'ON' state, according to the present invention, FIG. 4C is a diagram showing an example of a display screen which indicates that the pitch of a guitar string is low when the display device for guitar tuners is in an 'ON' state while tuning is being performed, according to the present invention, FIG. 4D is a diagram showing an example of a display screen which indicates that the pitch of a guitar string is high when the display device for guitar tuners is in an 'ON' state while tuning is being performed, according to the present invention, and FIG. 4E is a diagram showing a display screen which indicates that tuning is completed when the display device for guitar tuners is in an 'ON' state, according to the present invention.

For convenience, no color is indicated on the display screens of the LCD panel, shown in the respective drawings.

When the power switch 15 of the equalizer 1 is turned on in the state of FIG. 4A, a tuner operates, and the control unit 20 controls the LCD panel 11 and the backlight 12.

When the tuner operates, an inverse triangular central reference indication and a mode indication 'CHROMA' is displayed on the LCD panel 11, as shown in FIG. 46, and the backlight 12 emits light having a predetermined color. In this case, the predetermined color is orange.

In this state, the tuning of the guitar strings 2 is conducted while the guitar strings 2 are strummed or plucked. When the pitch of a guitar string is too low, an arrow indication is displayed on the LCD panel 11 and is located to the left of the central reference indication, as shown in FIG. 4C. In greater detail, the arrow indication is located such that it is spaced apart from the central reference indication to the left as the pitch of the guitar string decreases, and its location approaches the central reference indication as the guitar string's pitch becomes closer to the reference pitch. When the pitch of a guitar string is too high, the arrow indication is displayed on the LCD panel 11 and is located to the right of the central reference indication, as shown in FIG. 4D. In greater detail, the arrow indication is located such that it is be spaced apart from the central reference indication to the right as the pitch of the guitar string increases, and its location approaches the central reference indication as the guitar string's pitch becomes closer to the reference pitch.

Figure 5:
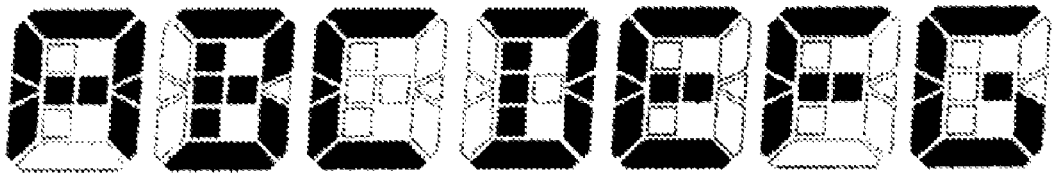
FIG. 5 is a diagram showing an example of pitch indications of guitar strings, which are displayed on the display screen of the display device for guitar tuners, according to the present invention.

The inverted triangular central reference indication 5 below the 'D' indicates the pitch corresponding to the guitar string. These pitch indicators are classified into seven types corresponding to the alphabet letters 'A' to 'G', as shown in FIG. 5.

When tuning is conducted as described, the backlight 12 10 emits light having an orange color, and thus the LCD panel 11 is brightly viewed in orange color.

When the guitar pitch has been tuned to the corresponding intrinsic reference pitch, that is, when tuning is completed, a diamond-shaped indication is displayed under the central reference indication and, at the same time, control is performed such that the backlight 12 emits light having a different color. The different color is green. This state is shown in FIG. 4E.

In this state, the backlight 12 emits light having a 20 green color, and thus the LCD panel 11 is brightly viewed in the green color.

A player can tune the guitar strings while the backlight 12 emits light as described, so that the pitches of the guitar strings can be easily observed during the tuning process.

Furthermore, the color of light emitted from the backlight 12 changes when the tuning is completed, so that the fact that the tuning has been completed can be quickly known.

Accordingly, in the case where it is necessary to play a guitar in which the display device 10 for guitar tuners according to the present invention is provided, the guitar can be quickly and easily tuned, in particular, tuning can be easily conducted even in dark places.

In accordance with the display device for guitar tuners and the method of displaying the tuned states of guitar strings using the same according to the present invention, the display device is provided in the equalizer, which is mounted in the guitar body, the backlight is mounted to the display device for displaying the tuned states of guitar strings, the LCD panel is made bright when the tuner operates, and the color of light emitted from the LCD panel changes when tuning is completed, so that a player can easily observe the tuned states even in dark places. Furthermore, the tuning completion state can be easily known, so that tuning is convenient for a player.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A method of displaying tuned states of guitar strings, comprising the following steps:

providing a display device, the display device including an LCD panel provided in an equalizer mounted to a guitar body, and configured to display the tuned states of the guitar strings;

providing a backlight mounted behind the LCD panel;

providing a control unit configured to control the LCD panel and the backlight;

providing a buffering member interposed between the backlight and the control unit for protecting the LCD panel and backlight;

performing a first control step by the control unit, wherein during said first control step, the backlight emits light having a predetermined color by turning on the backlight when a tuner is turned on;

performing a second control step by said control unit after completion of said first control step by the control unit, wherein during said second control step the backlight emits light having a different color when tuning of the guitar strings is completed;

displaying a central reference indication representing a reference pitch of said guitar on said LCD panel when the tuner operates, wherein when the pitch of a guitar string is too low relative to said central reference indication, an arrow indication is displayed on the LCD panel spaced apart and to the left of the central reference indication, wherein a position of said arrow indication approaches the central reference indication as the guitar string pitch approaches the reference pitch, and wherein when the pitch of a guitar string is too high, the arrow indication is displayed on the LCD panel spaced apart and to the right of the central reference indication, such that as the pitch of the guitar string increases, the position of said arrow indication approaches the central reference indication as the guitar string pitch approaches the reference pitch.

2. The method as set forth in claim 1, wherein during the first control step, the backlight emits light having an orange color when the tuner is turned on, and wherein during the second control step, the backlight emits changed light having a green color when tuning of the guitar strings is completed.

* * * * *